United States Patent [19]

Cielaszyk et al.

[11] 3,935,433

[45] Jan. 27, 1976

[54] ELECTROMAGNETICALLY OPERATED REMOTE METER OR REGISTER HAVING COUNTER WHEEL LOCKING MEANS

[75] Inventors: Edward F. Cielaszyk, Olgesby; Ralph A. DeRose, Villa Park; John W. Kravcik, Western Springs, all of Ill.

[73] Assignee: Neptune International Corporation, Atlanta, Ga.

[22] Filed: May 10, 1974

[21] Appl. No.: 468,730

[52] U.S. Cl. ..... 235/92 C; 235/92 R; 235/92 FL; 235/91 M

[51] Int. Cl.[2] ..... G06M 1/10; G06M 3/12

[58] Field of Search ..... 235/92 C, 92 FP, 92 FL, 235/130 R, 91 M, 139, 141; 335/140

[56] References Cited

UNITED STATES PATENTS

| | | | |
|---|---|---|---|
| 2,798,670 | 7/1957 | Boyer | 235/92 C |
| 3,400,255 | 9/1968 | Vroom | 235/92 FL |
| 3,775,596 | 11/1973 | Zielke | 235/92 C |

*Primary Examiner*—Joseph M. Thesz, Jr.
*Attorney, Agent, or Firm*—Cooper, Dunham, Clark, Griffin & Moran

[57] ABSTRACT

An improved remote register is provided with a novel locking device for prevention of rotation of the digital counter upon removal of the register cover. The cover includes an integral cam positioned to disengage the lock upon replacement of the cover. The remote register further includes integral mounting brackets and an electromagnetic relay having a unitary pawl and armature.

10 Claims, 5 Drawing Figures

ELECTROMAGNETICALLY OPERATED REMOTE METER OR REGISTER HAVING COUNTER WHEEL LOCKING MEANS

BACKGROUND OF THE INVENTION

The present invention relates generally to remote registers and more particularly to a remote register used in combination with a fluid-flow meter such as a conventional water meter. Normally, a water meter is found in the basement or garage of a private home or building and, as such, is not readily available for periodic readings. To eliminate this inconvenience, water meters are provided with an impulse generator, the impulse generator being adapted to transmit an electrical impulse to a remote register located at an outside position. The electrical impulse is generated in response to predetermined amounts of fluid flowing through the meter, as for example, 10, 100 or 1,000 gallons. At each actuation of an impulse, the remote register indicates the appropriate numerical information. Numerous generators are applicable for the present invention which periodically generates an electrical impulse in response to a predetermined volume of flow.

Remote registers referred to above are known in the art and generally comprise a casing in which is mounted an electromagnetic counting mechanism having a plurality of numbered wheels mounted coaxially on a shaft and operable by means of interacting transfer pinions to register a numerical value.

Heretofore, numerous problems have been associated with the known types of remote registers. Of primary importance is the fact that the numbered wheels may be inadvertently rotated when the cover is removed for inspection or maintenance. This obviously leads to subsequent incorrect readings. In order to negate the aforesaid, it is an object of the present invention to provide a remote register unit having a locking mechanism which automatically prevents rotation of the numbered wheels when the register cover is removed.

It is a further object of the invention to provide a remote register having integral construction.

Other objects and advantages of the present invention will become apparent to those skilled in the art upon a further reading of the specification.

SUMMARY OF THE INVENTION

In accordance with the present invention a remote register is provided which comprises a base and removable cover, the base member includes integral means for mounting an electromagnetic relay and a counter system comprising a plurality of numbered wheels coaxially and rotatably mounted on a shaft, one of the numbered wheels including a ratchet wheel, transfer pinions coaxially mounted to a shaft to operatively engage the numbered wheels; locking means normally biased to engage and lock the transfer pinions, the locking means comprising a bar mounted parallel to the transfer pinion shaft and including an actuating extension; the cover including an integral cam positioned to engage the extension, whereby upon positioning the cover on the base, the extension and bar are forced away from engagement with the transfer pinions.

The base and cover may be of any desired size and generally are of rectangular configuration. As in standard devices, the cover includes a generally rectangular window thus to permit viewing of the top-most numbers of each numbered wheel. These numbers may optionally indicate rate or volume of fluid flow.

There has thus been broadly outlined the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may be utilized as a basis for the designing of other structures for carrying out the several purposes of the invention. It is important, therefore, that the claims be regarded as including such equivalent constructions as do not depart from the spirit and scope of the invention.

DESCRIPTION OF THE PREFERRED EMBODIMENT

Figure 1:
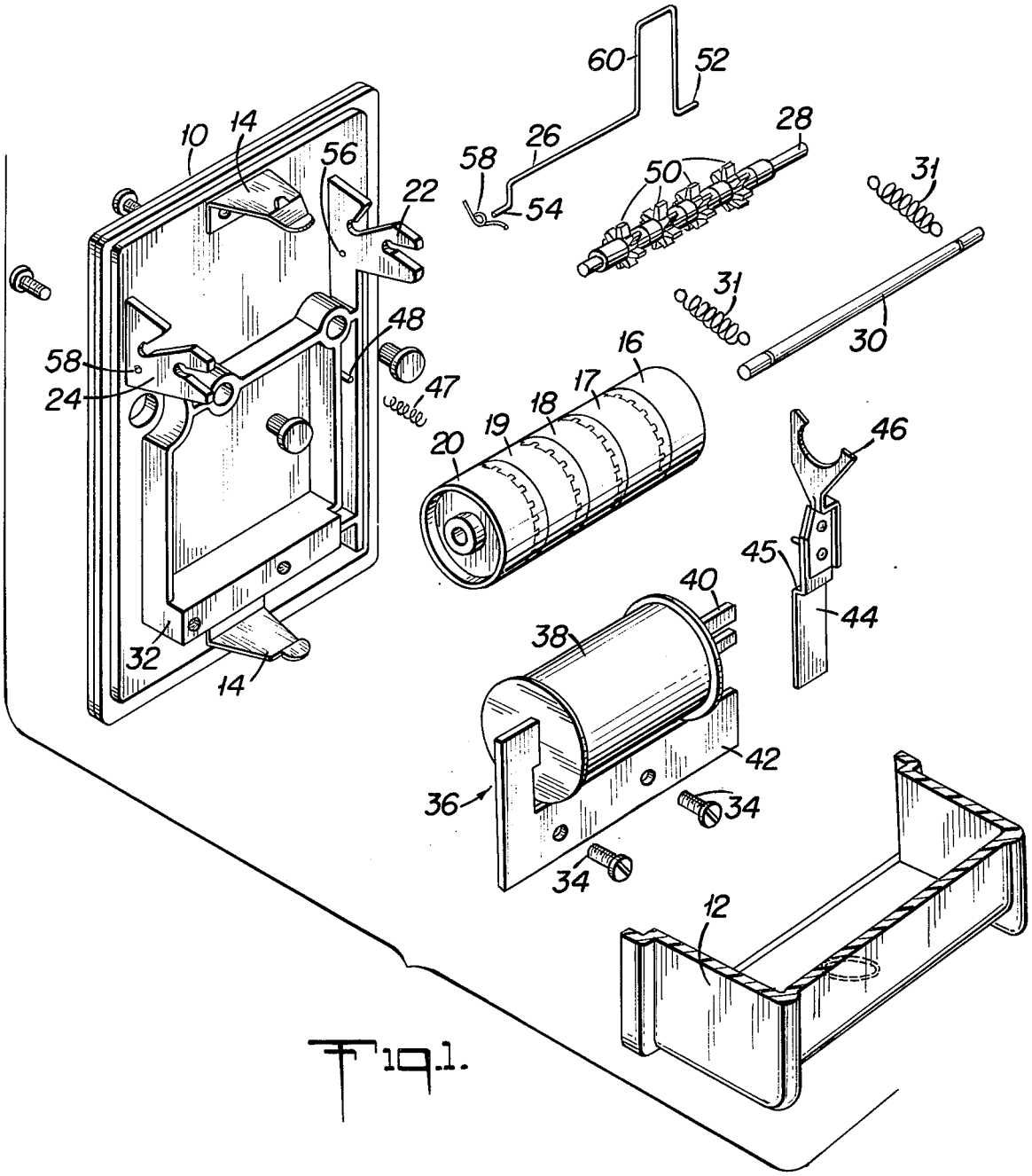
FIG. 1 is an exploded view of the remote register of the invention.

With reference to FIG. 1, the remote register of the invention comprises a base generally indicated by the numeral 10, and a cover generally indicated by the numeral 12, the base and cover have mating edges forming a watertight seal and are retained in closed relationship by means of spring clips 14. The cover 12 and base 10 are constructed of any suitable material and preferably are of plastic. As stated above, the cover includes a window (not shown) through which a person may view the numerals registered on numbered wheels 16, 17, 18, 19 and 20, the arrangement of which will be discussed hereinafter.

For mounting the various elements of the register, integral structure is provided with the base member 10, and to this end, it is preferred to form the entire base 10 and supporting elements of plastic which can be readily manufactured, for example, by a suitable molding process. The integral nature of the base and mounting members lends to the effectiveness of the invention by reducing the number of individual elements and thus materially negating the possibility of failure and repair.

Integrally provided with base 10 are a pair of support posts 22 and 24 each having identical retention means for mounting the locking bar 26, transfer pinion shaft 28 and numbered wheel shaft 30. The base 10 further includes an integral mounting block 32 to which is secured, by any suitable means such as screws 34, a relay mechanism generally indication by the numeral 36.

The relay mechanism comprises a winding 38 and a C-shaped core having generally parallel arms 40 and 42. Arm 40 is bifurcated for reciprocally mounting armature 44 thereon as is more clearly illustrated in FIG. 2. To this end, the armature 44 is formed with an intermediate step 45 and is thus generally S-shaped in longitudinal cross section. Step 45 of armature 44 loosely fits within the bifurcation of core arm 40, thus permitting limited pivoting of armature 44. Armature 44 is normally biased into a non-contact position by compression spring 47 which in turn is mounted on base 10 on an integral post 48. Armature 44 further includes, as an extension on one end thereof, a stepping pawl 46.

Figure 2:
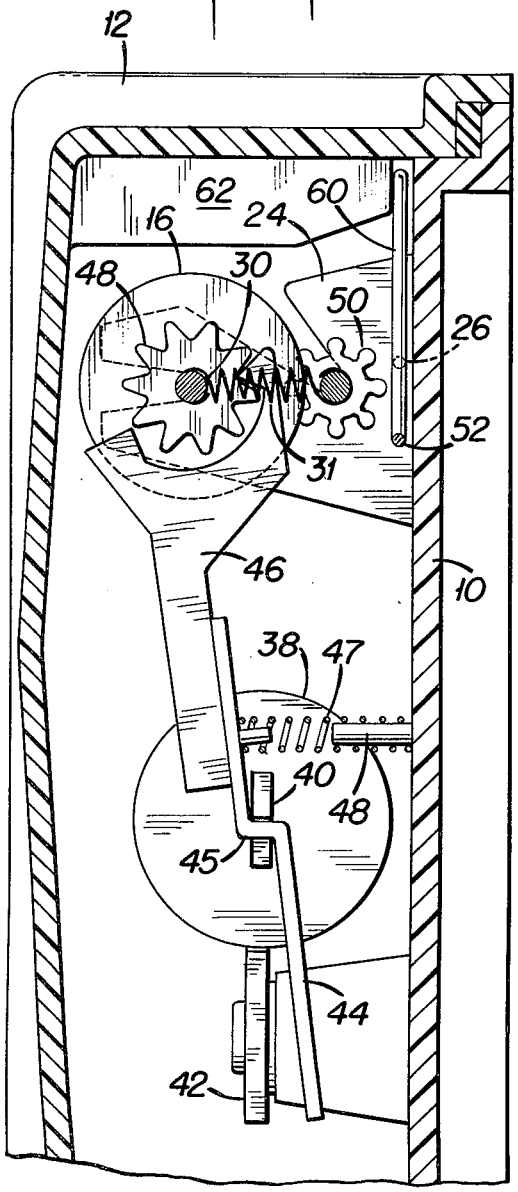
FIG. 2 is a side elevation view illustrating the locking mechanism when the cover is in place.

It is preferred that the stepping pawl 46 be constructed of a non-conductive material such as plastic. Accordingly, the stepping pawl 46 is connected to armature 44 by any securing means such as by rivets. As shown in FIG. 2, one of the rivets may provide cooperating retention means for compression spring 47.

Referring now to the counter assembly, the numbered wheels 16 through 20 are coaxially mounted on shaft 30 and the latter is mounted to posts 22 and 24 and retained thereon by springs 31. Each wheel carries a series of numbers from 0 to 9 progressing in clockwise manner whereby upon clockwise rotation thereof a progressively higher number is shifted to a position opposite the viewing window of the cover. Numbered wheel 16 indicates the lowest digits such as 1's, 10's, or 100's and includes a ratchet wheel 48 (FIG. 2) which cooperates with stepping pawl 46 for sequential rotation. Numbered wheels 17 through 20 are sequentially rotated in known manner by means of transfer pinions 50 coaxially mounted on shaft 28 which is secured in posts 22 and 24 by press fit. The sequential rotation of the numbered wheels by means of the transfer pinions is well known and, therefore, will not be described in detail. Simply stated, each wheel carries a cog (not shown) which engages a transfer pinion 50 upon a full rotation of that wheel. The transfer pinion acts to shift the next wheel one position for each full rotation of the preceding wheel.

Shafts 28 and 30 of transfer pinions 50 and numbered wheels 17–20 are uniquely coupled by springs 31, as shown. Such arrangement allows for simplicity of assembly as the shaft 30 carrying numbered wheels 17–20 merely snaps into slots 33 of fixed posts 22 and 24. Such arrangement allows for relaxation of the tolerances and provides a floating characteristic to the assembly. Moreover, resetting of the numbered wheels is accomplished with facility and setting of the wheels may be done individually.

Figure 5:
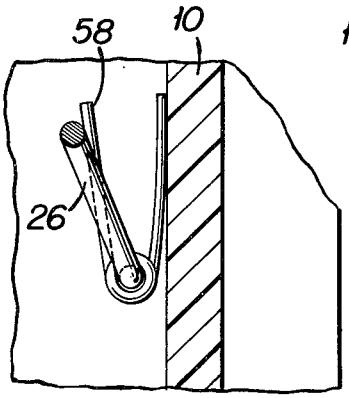
FIG. 5 is a view taken along line 5—5 of FIG. 4.
Figure 4:
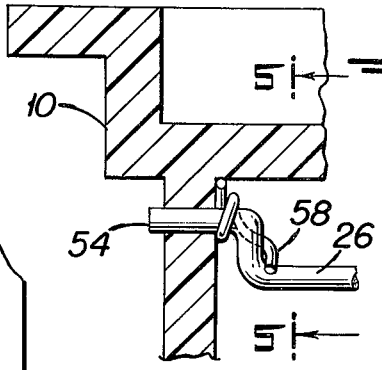
FIG. 4 is a plan view of the biasing element for the locking device.

Also fixed to posts 22 and 24 is a locking member. The locking member includes a bar 26, preferably terminating in L-shaped end extensions 52, 54 for mounting within retention holes 56,58 of posts 22 and 24 and thus providing for pivotal movement of bar 26. Locking bar 26 further includes a generally U-shaped section 60 which acts in cooperation with a cam in a manner to be described hereinafter. Biasing means are provided in association with the locking bar to normally urge the bar in a direction away from base 10. As is shown clearly in FIGS. 4 and 5, the biasing means preferably is a torsion spring 58 having one arm engaging the base 10 and the other arm engaging locking bar 26, thus adapted to normally force the locking bar 26 away from the plane of the base 10 and toward the transfer pinions 50. Although the locking bar arrangement has been described herein with reference to a torsion type spring and a specific configuration, it is to be understood that any type of biasing means and configuration is appropriate for the invention as long as the bar is pivotal along an axis substantially parallel to the base and transfer pinions and is biased in a direction generally away from the base and towards the transfer pinions to engage the same.

Figure 3:
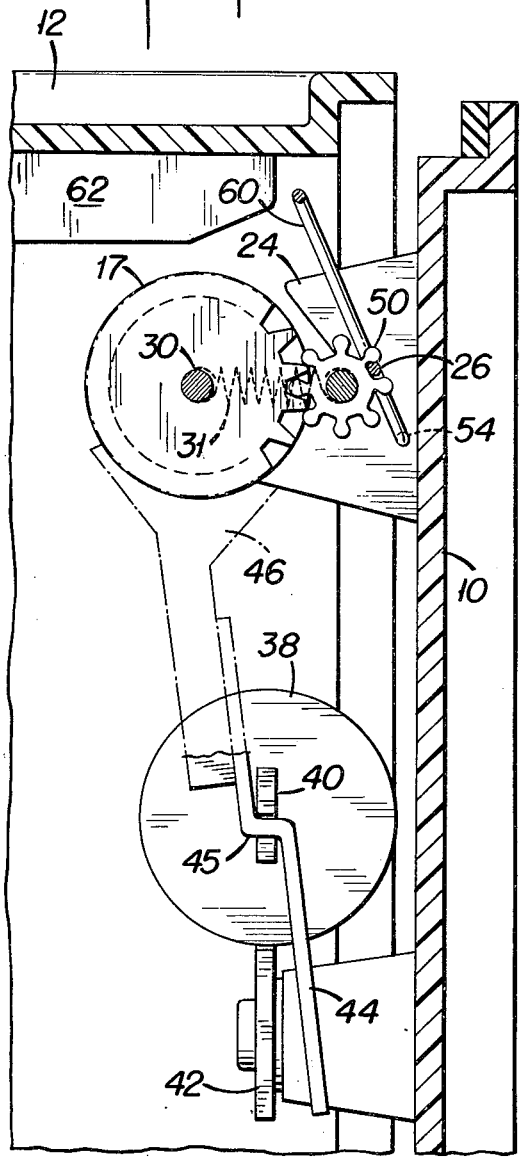
FIG. 3 is a view similar to FIG. 2 but partially in phantom illustrating the locking mechanism when the cover is partially removed.

The locking operation will now be described with reference to FIGS. 2 and 3. As shown in these figures, cover 12 includes, as an integral part, at least one inwardly directed cam 62 which is positioned to engage an actuating extension 60 of locking bar 26. Thus, when cover 12 is closed, as shown in FIG. 2, cam 62 engages extension 60, forcing locking bar 26 away from transfer pinions 50 and this position corresponds to the unlocked or operative position which permits free rotation of transfer pinions 15 and numbered wheels 16–20 by action of stepping pawl 46. However, when cover 12 is removed, as shown in FIG. 3, cam 62 disengages extension 60 thereby permitting locking bar 26 to move in its normally biased direction away from base 10 by the action of spring 58. At its fully extended position, locking bar 26 engages transfer pinions 50 thus preventing rotation thereof as shown in FIG. 3. In such manner transfer pinions 50 as well as the numbered wheels 16–20 are effectively locked against inadvertent rotation while cover 12 is removed.

Although not forming a part of the invention herein described, one skilled in the art will appreciate that the remote register described herein includes suitable electrical contact leads directed from relay 36 to a pulse generator (not shown) at the cite of a standard metering device.

From the foregoing it will be appreciated that the remote register of the invention fulfills the objects hereof in providing for locking of the counter mechanism upon removal of the cover and further in providing a device of unitary construction subject to less likelihood of breakage and repair.

What is claimed is:

1. In a remote register comprising a base and cover, relay means including an armature, a stepping pawl and a plurality of numbered wheels coaxially mounted on a shaft for sequential rotation, said wheels being operatively interconnected by transfer pinions rotatably mounted on a shaft, one of said numbered wheels including a ratchet wheel engageable by said stepping pawl, the improvement which comprises:

locking means including a bar pivotally mounted along an axis parallel to said base and said transfer pinion shaft, said locking means including an actuating member;

biasing means arranged to normally urge said locking bar into engagement with said transfer pinions; and cam means operatively associated with said cover and positioned to engage said actuating member and to force said locking means against the action of said biasing means out of engagement with said transfer pinions when said cover is positioned on said base and to release said locking means when said cover is removed from said base whereby upon removal of said cover, said cam disengages said actuating member and said locking bar is urged into engagement with said transfer pinions to prevent said transfer pinions and numbered wheels from rotation.

2. A remote register according to claim 1 wherein said base includes a pair of integral mounting posts having retention means for mounting said numbered wheel shaft, said transfer pinion shaft and said locking means thereon.

3. A device according to claim 1 wherein said base includes an integral mounting block to which said relay means is mounted.

4. A device according to claim 1 wherein said relay means comprises a winding, a C-shaped core, one arm of which is bifurcated and an armature pivotally positioned on said bifuracted arm.

5. A device according to claim 4 wherein said armature is integral with said stepping pawl.

6. A device according to claim 2 wherein said locking bar is characterized by L-shaped ends pivoted in said mounting posts, an elongate locking section, and a U-shaped actuating member.

7. A device according to claim 6 wherein said biasing means comprises a torsion spring having one arm engaging said base and another arm engaging said elongate locking section.

8. A device according to claim 1 wherein said cam comprises an integral post within said cover.

9. A remote register which comprises in combination:

a base including integral mounting posts and mounting block;

a cover dimensioned to close upon said base and including an integral inwardly disposed cam;

electrical relay means mounted to said mounting block and including a winding and a U-shaped core, one arm of said U-shaped core being bifurcated, an integral armature and stepping pawl pivotally mounted to said bifurcated arm;

a plurality of numbered wheels coaxially mounted to a shaft; said shaft being mounted to said mounting posts, one of said wheels including a ratchet wheel operatively engaging said stepping pawl;

a plurality of transfer pinions coaxially mounted on a shaft, said shaft being mounted to said mounting posts, said transfer pinions operatively engaging said numbered wheels for sequential rotation thereof; and locking means comprising a bar including L-shaped ends mounted pivotally to said mounting posts and a U-shaped actuating member positioned to engage said cam, a torsion spring normally urging said bar into engagement with said transfer pinions to prevent rotation thereof, whereby upon removal of said cover, said locking bar engages and fixes said transfer pinions and upon placement of said cover, said cam forces said actuating member and locking bar out of engagement with said transfer pinions.

10. A device according to claim 9 wherein said integral armature and stepping pawl includes an intermediate step dimensioned for reception and mounting on said bifurcated arm.

* * * * *